United States Patent [19]

Fanelli

[11] Patent Number: 4,511,338

[45] Date of Patent: Apr. 16, 1985

[54] WATER BICYCLE AND DETACHABLE DEVICE THEREFOR

[76] Inventor: Noël Fanelli, 15 Rue Berthollet, Mions (Rhone), France

[21] Appl. No.: 472,351

[22] Filed: Mar. 4, 1983

[51] Int. Cl.[3] ..... B63H 16/12

[52] U.S. Cl. ..... 440/26; 441/74; 114/58; 114/144 R; 440/29; 440/92

[58] Field of Search ..... 440/21–32, 440/53, 80, 90–94, 98–100, 104, 105; 114/58, 123, 144 R, 147, 39; 74/480 B; 441/74

[56] References Cited

U.S. PATENT DOCUMENTS

| | | | |
|---|---|---|---|
| 464,973 | 12/1891 | Kiah | 440/28 |
| 1,459,297 | 6/1923 | Swan | 440/92 |
| 2,824,539 | 2/1958 | Budney et al. | 440/26 |
| 3,249,084 | 5/1966 | Plants | 440/27 |
| 4,382,797 | 5/1983 | Blanchard | 440/53 |

FOREIGN PATENT DOCUMENTS

| | | | |
|---|---|---|---|
| 26721 | 4/1981 | European Pat. Off. | 114/123 |
| 2654618 | 6/1978 | Fed. Rep. of Germany | 440/105 |

*Primary Examiner*—Trygve M. Blix
*Assistant Examiner*—Stephen P. Avila
*Attorney, Agent, or Firm*—Remy J. VanOphem

[57] ABSTRACT

A water bicycle and a detachable device for converting a sail board into a water bicycle. The water bicycle has a flotation member and a frame removably mounted to the flotation member. Pedals are rotatably mounted to the frame. Paddle wheels are provided on either side of the frame and are interconnected with the pedals so as to be rotatably driven by the pedals. A steering handle is rotatably mounted to the frame and is interconnected with the paddle wheels to selectively steer the water bicycle by raising and lowering the paddle wheels.

12 Claims, 5 Drawing Figures

1
2
3
4
5
7
8
9
9
13
14
15
16
18

WATER BICYCLE AND DETACHABLE DEVICE THEREFOR

BACKGROUND OF THE PRESENT INVENTION

The present invention relates to a detachable device intended to make a floating bicycle or the like in a demountable and a transportable form. In particular, the present invention relates to a device which is very easily mounted onto the flotation member of a commercially available sail board, to convert the sail board into a floating bicycle.

The importance of nautical sports in the leisure industry is well known. In particular, there has recently been a spectacular increase in the numbers of sail board sales.

The primary object of the present invention is to create a detachable device which permits the users of a sail board to convert it into a new and attractive apparatus which may be referred to as a "water bicycle".

SUMMARY OF THE PRESENT INVENTION

A detachable device according to the present invention, intended to be mounted in a detachable manner on the flotation member of a sail board, is characterized in that it includes at least one seat, two pedals and two paddle wheels situated below the level of the seat and on either side thereof. The device is carried by a frame including a base equipped with removable interconnected means facilitating interconnection of the device to the upper face of the flotation member of a sail board.

In particular, in one example of structure of the invention, the base is generally flat and is equipped with two pliable straps, each of which can be stretched around the flotation portion of the sail board and refastened to itself by known means.

The pedals may be formed integrally with a crank gear assembly which they drive in rotation. This crank gear assembly consists of a first notched gear which, by means of a notched chain, rotatably drives a second notched gear formed integrally with the central part of a transverse shaft equipped at each end with one of the two paddle wheels of the detachable device.

Furthermore, the transverse shaft carrying the paddle wheels preferably rotates in a steering control box which is hinged relative to the support of the entire detachable device. Thus, the paddle wheels may selectively swing about a shaft running longitudinally to the flotation member of the sail board. The steering control box is interconnected with the steering handle bar such that one of the paddle wheels may be lower in the water while the other is raised, in response to a movement of the steering handle bar by the operator in the direction of the paddle wheel to be raised.

The many objects, features and advantages of the present invention will be apparent to those skilled in the art when the following detailed description is read together with the drawings appended hereto.

DETAILED DESCRIPTION OF THE PREFERRED EMBODIMENT

Figure 1:
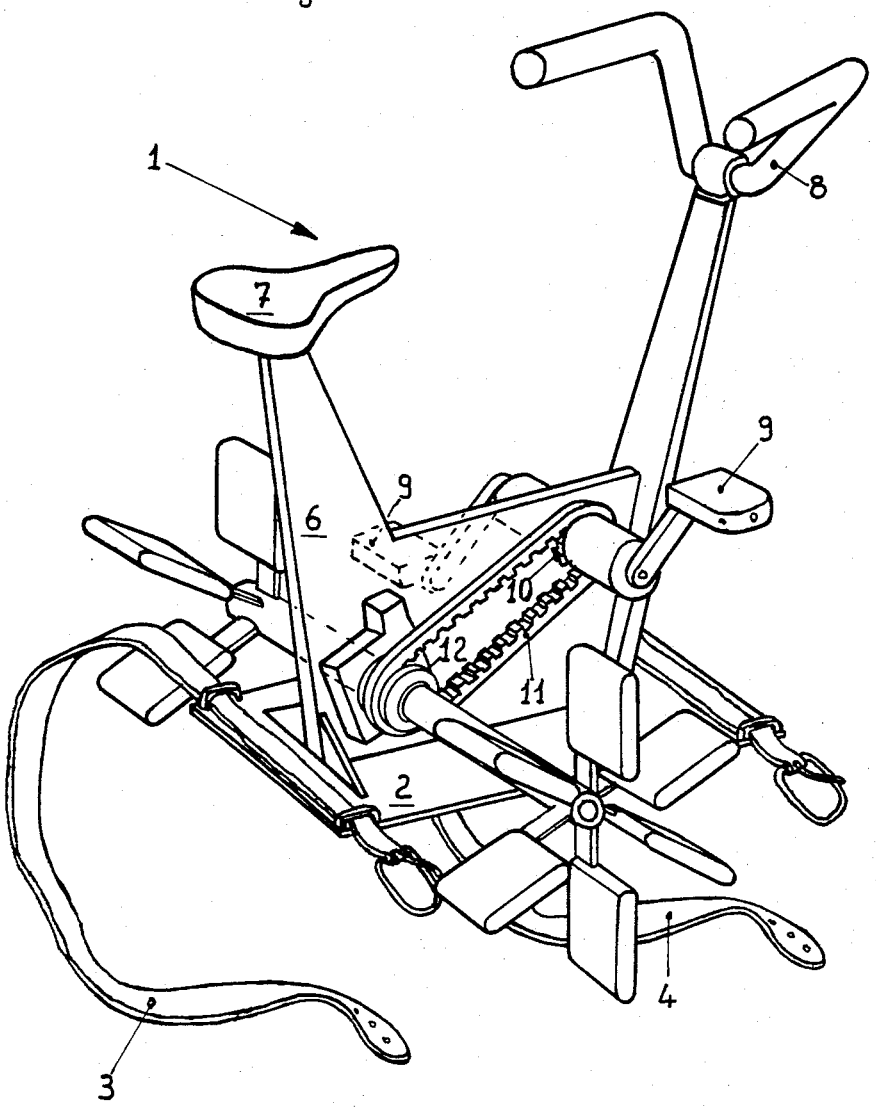
FIG. 1 is a perspective view of an example of a detachable device according to the invention.
Figure 2:
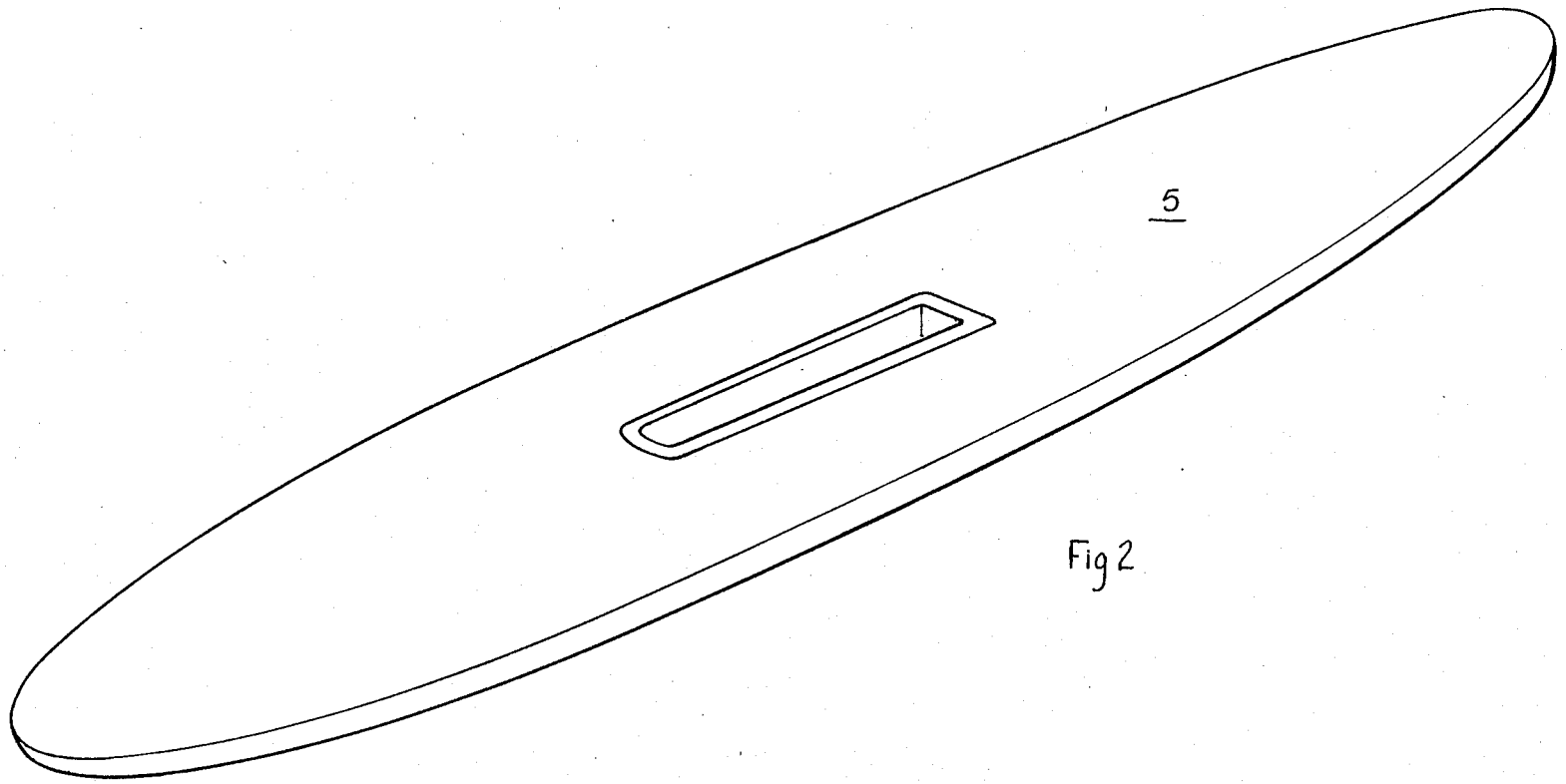
FIG. 2 is a perspective view of the flotation member of a sail board of a known type.
Figure 3:
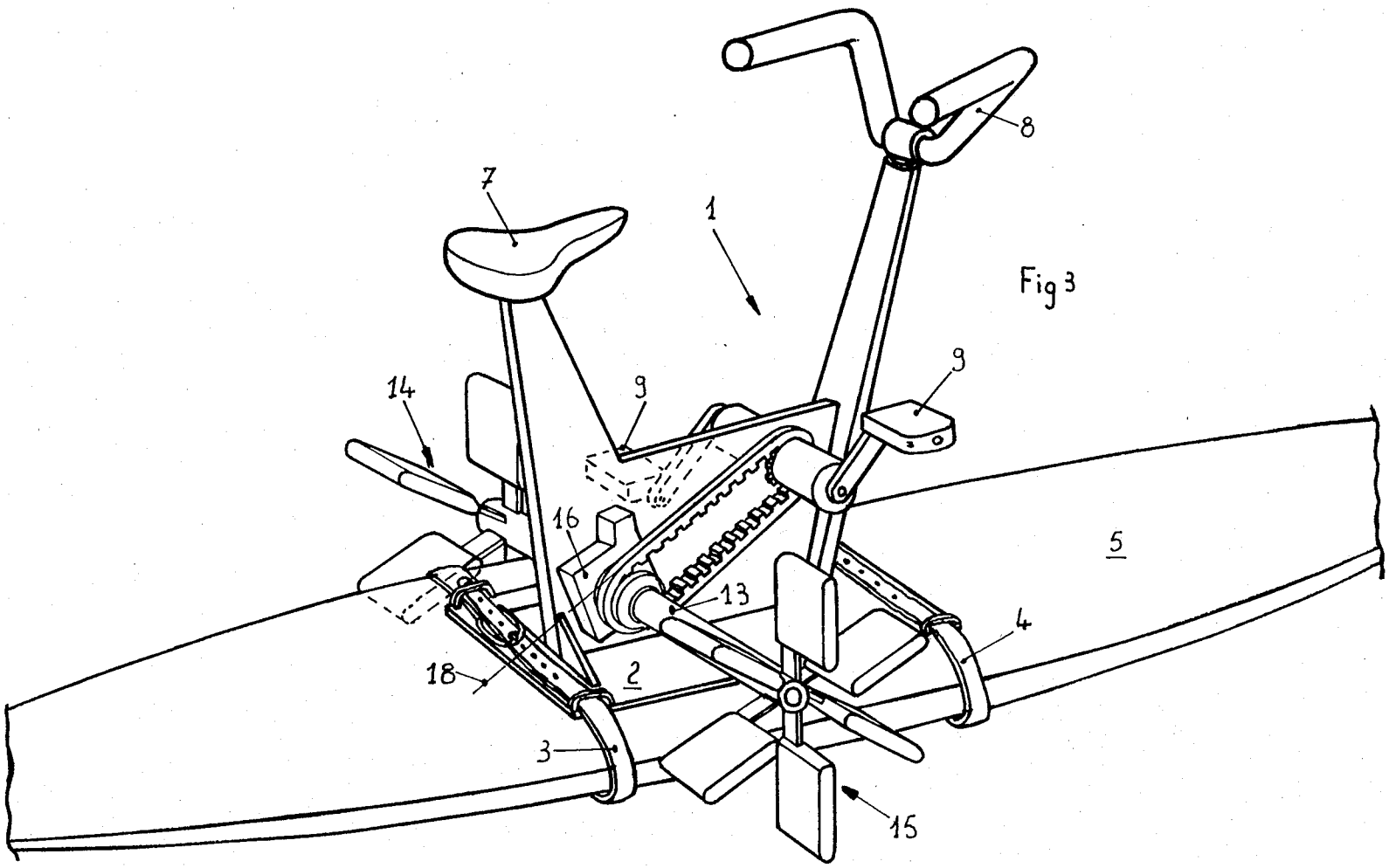
FIG. 3 is a perspective view of the detachable device of FIG. 1 mounted on the known flotation member of FIG. 2.

Referring now to the drawings and more particularly to FIGS. 1 and 3 thereof, an example of a detachable bicycle device 1 according to the present invention is illustrated. The detachable bicycle device includes a lower support 2 provided with two straps 3 and 4 for detachably affixing the device to the flotation member 5 (FIGS. 2 and 3) of a sail board.

A frame 6 extends upwardly from the support 2. A seat 7 and a steerable handle bar 8 are interconnected with the support 2. Two pedals 9 are provided between the seat 7 and the steerable handle bar 8 above the support 2, as on a bicycle, permitting an operator to rotatably drive a notched crank gear 10. The notched crank gear 10 drives an endless notched chain 11 which, in turn, drives a receiving notched gear 12. The receiving notched gear 12 is mounted to a transverse shaft 13 and keyed thereto. A paddle wheel 14 or 15 is provided at each end of the transverse shaft 13. The transverse shaft 13 is carried by a steering control box 16 in which it rotates.

Figure 5:
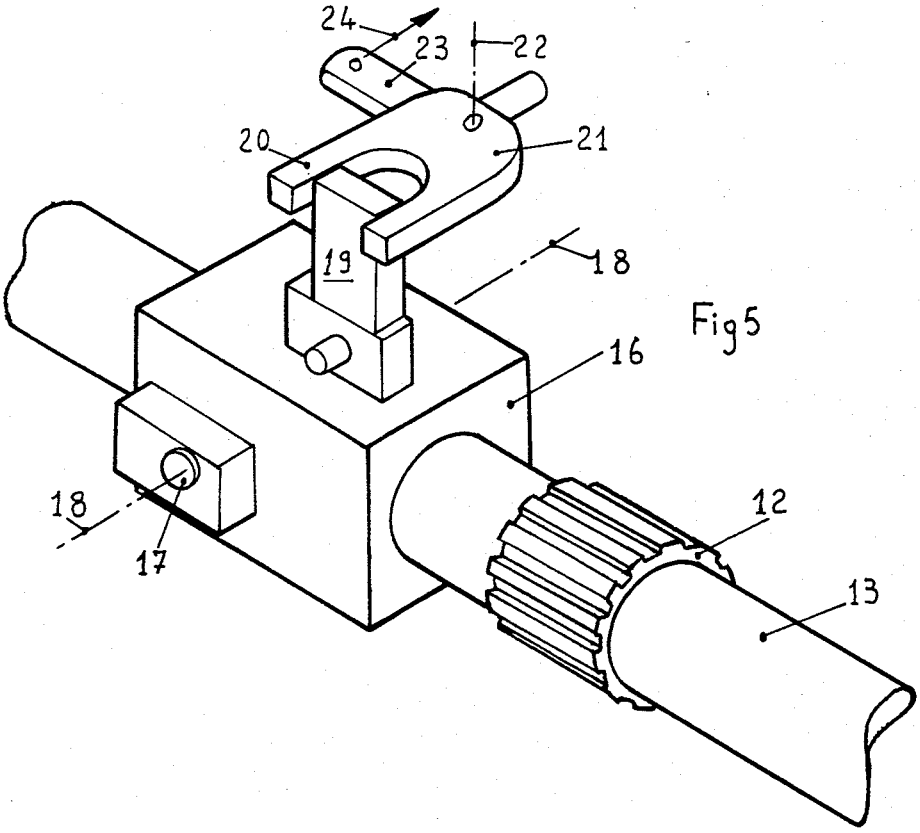
FIG. 5 is a partial perspective view of the steering control box of the detachable device of FIG. 1 as well as associated components.
Figure 4:
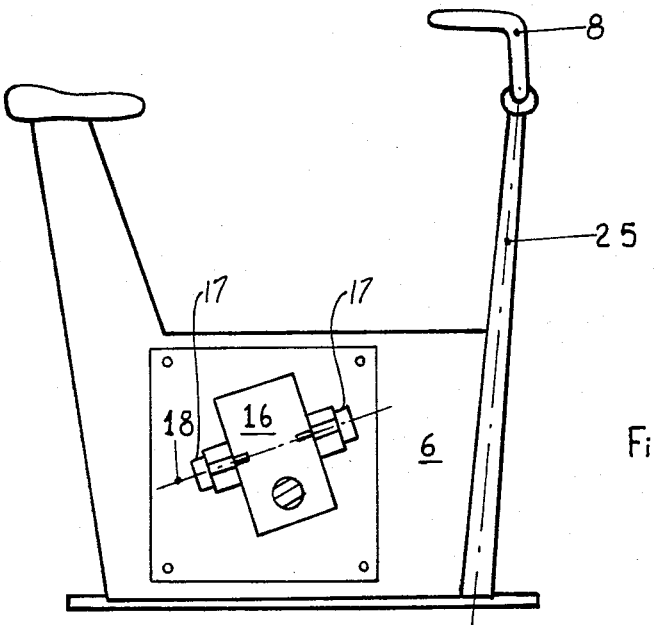
FIG. 4 is a side elevational view of a portion of the detachable device of FIG. 1 illustrating the steering control box and the drive shaft thereof.

As illustrated in FIGS. 4 and 5, the steering control box 16 is provided on its front and rear surfaces with two projections 17 which together define a rocking shaft the axis 18 of which is oriented longitudinally with respect to the frame 6. A tongue 19 is formed in the top of the steering control box 16. The tongue 19 is pivotally mounted between the two arms 20 of a fork 21 which, in turn, is pivotally mounted to a shaft 22. The shaft 22 is mounted substantially vertically to the frame 6. The fork 21 is interconnected with an angle lever 23, which is connected, by means of a cable or connecting rod, with a steering column, in a manner not illustrated but apparent to one skilled in the art, which is formed integrally with the steerable handle bar 8. The steerable handle bar 8 pivots around an approximately vertical shaft 25, in the same manner as a bicycle handle bar.

The operation of the device of the present invention is as follows.

When the user desires to convert a sail board into a water bicycle, such conversion may be accomplished by buckling the two straps 3 and 4 around the flotation member 5 to obtain the water bicycle apparatus illustrated in FIG. 3. It will be noted that this operation can be performed on any type of flotation member 5, the straps 3 and 4 permitting automatic adaptation for various sized flotation members.

When the user sits on the seat 7 and operates the pedals 9 to pedal in a manner similar to the operation of a bicycle, this causes the rotation of the paddle wheels 14 and 15 which, in turn, cause the entire assembly to move forward on the water.

When the user turns the steerable handle bar 8 to the right for example, the connecting rod pulls on the fork 21 in the direction shown in FIG. 5 by the arrow 24, so that the steering unit consisting of the steering control box 16, the transverse shaft 13 and the paddle wheels 14 and 15, pivot about the rocking shaft axis 18. During this pivoting movement, the paddle wheel 14 remains in the water while the paddle wheel 15 is raised from the water. The result is that the entire water bicycle assembly has a tendency to turn to the right. Of course a similar operation occurs in the opposite direction when the user turns the steerable handle bar 8 to the left.

It is thus readily apparent that the device of the present invention permits the user to turn right and left without using a rudder, and without the need of making any alteration to the flotation member 5 of the sail board other than the removable attachment of the two straps 3 and 4 therearound.

Thus the transformation operation is particularly simple and can be carried out quickly without requiring any tools.

The above constitutes a detailed description of the best mode contemplated by the inventor at the time of filing the present application. Variations and modifications will be apparent to those skilled in the art and are intended to be included within the scope of the claims appended hereto.

What is claimed as novel is as follows:

1. A detachable bicycle device for converting a sail board member into a water bicycle to propel said sail board member along a body of water, said device comprising:

a longitudinal frame member detachably mounted to said sail board member;

a steering handle rotatably mounted to said longitudinal frame member;

a drive shaft transversely mounted to said longitudinal frame member, said drive shaft having one end extending beyond one side of said sail board member, an opposite end extending beyond another side of said sail board member and an intermediate portion rotatably mounted to said longitudinal frame member, said drive shaft further defining a drive axis transverse to said longitudinal frame member;

a pair of paddle wheels, one of said pair of paddle wheels being mounted to said one end of said drive shaft and extending beyond said sail board member, the other of said pair of paddle wheels being mounted to said opposite end of said drive shaft and extending beyond said sail board member, said pair of paddle wheels further extending beyond a bottom surface of said sail board member such as to engage said body of water below said sail board member;

means for driving said drive shaft, said driving means being mounted to said longitudinal frame member to selectively rotate said drive shaft to propel said water bicycle along said body of water; and means for steering said bicycle in said body of water, said means for steering mounted to said drive shaft for cooperation therewith, said means for steering having a steering axis substantially perpendicular to said drive axis and means for pivoting said drive shaft about said steering axis such that as said drive shaft is pivoted about said steering axis one of said pair of paddle wheels is rotated upward in a direction away from the water such as to engage less of said body of water while the other of said pair of paddle wheels is rotated downwards such as to engage more of said body of water to thereby selectively steer said water bicycle in said body of water.

2. The detachable bicycle device as claimed in claim 1 wherein said means for pivoting said drive shaft comprises means interposed said steering handle and said drive shaft and automatically operable, in response to rotation of said steering handle, to pivot said drive shaft to raise one of said pair of paddle wheels and lower the other of said pair of paddle wheels.

3. The detachable bicycle device as claimed in claim 2 wherein said drive shaft is rotatably mounted in a steering control box and further wherein said steering box is pivotally fastened to said longitudinal frame member such as to pivot said steering axis perpendicular to said drive axis and further wherein said means for pivoting said drive shaft comprises link means interconnecting said steering handle with said steering control box whereby rotation of said steering handle imparts a pivoting motion to said steering control box.

4. The detachable bicycle device as claimed in claim 1 wherein said means for driving said drive shaft comprises pedals rotatably mounted to said longitudinal frame member and power transmission means interposed said pedals and said drive shaft.

5. The detachable bicycle device as claimed in claim 5 wherein said power transmission means comprises a toothed wheel rotatably mounted to said longitudinal frame member and rotated by said pedals, a second toothed wheel mounted on said drive shaft; and a toothed belt interposed said toothed wheels.

6. The detachable bicycle device as claimed in claim 1 wherein said longitudinal frame member comprises a flat lower frame member and a flat upwardly oriented frame member extending upwardly therefrom.

7. The detachable bicycle device as claimed in claim 1 wherein said longitudinal frame member is removably mounted to said sail board member.

8. The detachable bicycle device as claimed in claim 7 wherein said longitudinal frame member is removably mounted to said sail board member by means of at least one pliable strap selectively and removably wound about said sail board member and reclosed upon itself.

9. The detachable bicycle device as claimed in claim 5 wherein said drive shaft is rotatably mounted in said steering control box and further wherein said steering control box is pivotally fastened to said longitudinal frame member such as to pivot about said steering axis perpendicular to said drive axis and further wherein said means for pivoting said drive shaft comprises link means interconnecting said steering handle with said steering control box whereby rotation of said steering handle imparts a pivoting motion to said steering control box.

10. The detachable bicycle device as claimed in claim 8 wherein said means for driving said drive shaft comprises pedals rotatably mounted to said longitudinal frame member and power transmission means interposed said pedals and said drive shaft.

11. The detachable bicycle device as claimed in claim 10 wherein said power transmission means comprises a toothed wheel rotatably mounted to said longitudinal frame member and rotated by said pedals, a second toothed wheel mounted on said drive shaft; and a toothed belt interposed said toothed wheels.

12. The detachable bicycle device as claimed in claim 9 wherein said longitudinal frame member comprises a flat lower frame member and a flat upwardly oriented frame member extending upwardly therefrom.

* * * * *

UNITED STATES PATENT AND TRADEMARK OFFICE

CERTIFICATE OF CORRECTION

PATENT NO. : 4,511,338

DATED : April 16, 1985

INVENTOR(S) : Noel Fanelli

It is certified that error appears in the above-identified patent and that said Letters Patent is hereby corrected as shown below:

Column 2, line 47, delete the period "." and insert a colon ---- : ----.

Column 4, line 10, after "pivot" insert ---- about ----.

Signed and Sealed this

Sixth Day of August 1985

[SEAL]

*Attest:*

DONALD J. QUIGG

*Attesting Officer*

*Acting Commissioner of Patents and Trademarks*